US009797130B2

(12) United States Patent
Collins et al.

(10) Patent No.: US 9,797,130 B2
(45) Date of Patent: Oct. 24, 2017

(54) FIRE SHIELD FLASHING SYSTEM AND METHOD

(71) Applicant: YORK MANUFACTURING, INC, Sanford, ME (US)

(72) Inventors: Paul Michael Collins, Cincinnati, OH (US); Craig Wetmore, Cumberland, ME (US)

( * ) Notice: Subject to any disclaimer, the term of this patent is extended or adjusted under 35 U.S.C. 154(b) by 0 days.

(21) Appl. No.: 15/001,296

(22) Filed: Jan. 20, 2016

(65) Prior Publication Data

US 2017/0204602 A1 Jul. 20, 2017

(51) Int. Cl.

| | |
|---|---|
| ***E04B 1/70*** | (2006.01) |
| ***E02D 31/02*** | (2006.01) |
| ***E06B 1/62*** | (2006.01) |

(52) U.S. Cl.

CPC ..... *E04B 1/7053* (2013.01); *E04B 1/7046* (2013.01); *E02D 31/02* (2013.01); *E06B 2001/628* (2013.01)

(58) Field of Classification Search

CPC ..... E04B 1/7053; E04B 1/7046; E02D 31/02; E06B 2001/628

See application file for complete search history.

(56) References Cited

U.S. PATENT DOCUMENTS 5,937,600 A * 8/1999 Larson ..... E04B 1/762 52/302.6
5,979,123 A * 11/1999 Brockman ..... A01M 1/24 49/58
6,170,207 B1 * 1/2001 Saindon ..... E04B 1/7046 49/408
6,410,118 B1 * 6/2002 Reicherts ..... B32B 13/04 428/141
7,546,719 B1 * 6/2009 Guevara ..... E04F 13/06 52/302.6
7,621,079 B2 * 11/2009 Takagi ..... E04B 1/70 52/100
7,730,684 B1 * 6/2010 Keene ..... E04B 1/7061 52/169.5

(Continued)

OTHER PUBLICATIONS

National Institute of Building Sciences, Whole Building Design Guide, Window Head With Fin at Metal Panel, Fenestration Detail 1E (admitted prior art).

(Continued)

*Primary Examiner* — Brian Glessner
*Assistant Examiner* — Omar Hijaz
(74) *Attorney, Agent, or Firm* — Mesmer & Deleault, PLLC

(57) ABSTRACT

A fenestration flashing system includes a body member having a planar header leg extending horizontally from a rearward end to a forward end, a vertical leg extending upward from the forward end of the header leg, and a positively-sloped drainage leg extending upwardly and rearwardly from a top end of the vertical leg. A termination member has a vertical termination leg for attachment to the back-up wall and a positively-sloped drainage leg to overlap and attach to the positively-sloped drainage leg of the body member. The termination member and the body member define a drainage path down and out of the wall cavity. A method of flashing a fenestration of a cavity wall or non-cavity wall is also disclosed.

20 Claims, 8 Drawing Sheets

(56) References Cited

U.S. PATENT DOCUMENTS

| | | | | |
|---|---|---|---|---|
| 8,046,956 | B1 * | 11/2011 | Hohmann, Jr. | E02D 31/02 428/349 |
| 9,187,946 | B2 * | 11/2015 | Krause | E06B 1/62 |
| 2003/0177736 | A1 * | 9/2003 | Gatherum | E04B 1/70 52/741.1 |
| 2005/0055983 | A1 * | 3/2005 | Tomes | E04B 1/70 52/782.1 |
| 2006/0260213 | A1 * | 11/2006 | Williams | E06B 1/70 52/60 |
| 2007/0062137 | A1 * | 3/2007 | Maylon | E04F 13/06 52/367 |
| 2008/0229676 | A1 * | 9/2008 | Allen | E06B 1/62 52/58 |
| 2012/0233947 | A1 * | 9/2012 | Koch | E04B 1/644 52/302.1 |
| 2012/0255250 | A1 * | 10/2012 | Wetmore | E04B 1/644 52/302.6 |
| 2014/0202096 | A1 * | 7/2014 | Johnson | E04B 1/64 52/302.6 |
| 2014/0272238 | A1 * | 9/2014 | Hohmann, Jr. | E04B 1/7046 428/41.8 |

OTHER PUBLICATIONS

Keystone Lintels, Cavity Wall Lintel Information Sheet (admitted prior art).
Keystone Lintels, Solid Wall Single Leaf Lintel (admitted prior art).
Int'l Masonry Institute, Masonry Detailing Series: End Dam Diagram—Field-Formed Flashing End Dam (Feb. 4, 2011).
Chris Bupp, Mason Contractors Assoc. of Am., Addressing Moisture Infiltration (MCAA, Aug. 3, 2011).

* cited by examiner (prior art)

FIRE SHIELD FLASHING SYSTEM AND METHOD

BACKGROUND OF THE INVENTION

1. Field of Invention

The present invention relates to through-wall flashing systems and fire prevention. More particularly, the present invention relates to flashing systems and methods of installing flashing systems at fenestrations in cavity wall construction.

2. Description of the Related Art

FIG. 1 illustrates a perspective view of a portion of a traditional masonry veneer wall 10. Traditionally, masonry wall 10 is constructed having a back-up wall or inner wythe 12 and an outer wythe 14. Inner wythe 12 is typically made of concrete masonry block 16, brick, wood, or steel frame construction elements. Outer wythe 14 is typically made of brick 18, stone, concrete block, stucco, or other cladding products. The inner and outer wythes 12, 14 are separated by a cavity 20. The width of cavity 20 can be specified by building code or architectural design preference, but is commonly dimensioned up to about six inches. Cavity 20 allows for up to four inches of outbound insulation 29 and about two inches of an air gap 28 between face 29*a* of outbound insulation 29 and inner face 14*a* of outer wythe 14 (or between outer face 12*a* of inner wythe and inner face 14*a* of outer wythe 14.)

The primary purpose of a masonry wall 10 constructed with a cavity 20 is to establish a capillary break and drainage plane between the outer face 12*a* of the inner wythe 12*a* and the inner face of outer wythe 14*a*. The break provides an inbound drainage plane, which prevents moisture from transferring from the inner face 14*a* of the outer wythe 14*a* to the outer face 12*a* of the inner wythe 12, whether the moisture is due to condensation formed on the inner face 14*a* or to water leaking through the outer wythe 14 to the inner face 14*a* of the outer wythe 14. The cavity 20 also helps reduce heat transfer by providing a blanket of air between wythes 12, 14. Water that penetrates the outer wythe 14 or that condenses on the inner face 14*a* of the outer wythe 14 will run down the inner face of 14*a* of the outer wythe 14 to a point where the downward flow 19 is redirected by the horizontal plane of the through-wall flashing membrane 22 located at and along the head of a fenestration a steel lintel 21. Moisture then continues to travel outward through weeps (not shown) embedded in the outer wythe 14. Water that condenses on the outer face 12*a* face of the inner wall 12*a* will drain downward onto the through-wall flashing membrane 22 and outward through the weeps by way of a weep device. The weep device can be a metal or plastic tube, a rope, or other device that extends horizontally through the outer wythe 14.

A through-wall flashing membrane 22 is one form of above-grade waterproofing that protects inner surfaces 12*a*, 14*a* of a masonry wall 10 from water intrusion. For water that forms in or enters the cavity 20, the through-wall flashing membrane 22 also directs this water out of masonry wall 10. Flashing is mandated in the International Building Code Section 1405.4, which states, "flashing shall be installed in such a manner so as to prevent moisture from entering the wall or to redirect it to the exterior." Failure to comply with this code exposes the structural and interior wall components to water and associative rot, threatens indoor air quality, and reduces energy efficiency.

Traditional through-wall flashing membrane 22 is made of a continuously-formed, fitted, and sealed metal material (copper, stainless steel, or lead) or a continuously-formed, fitted, and sealed adhered or loose-laid waterproof membrane, all of which should be sloped to drain. To prevent delamination of a sealed joint, adhered and loose-laid membranes require full structural support to avoid sagging across gaps. Repairing failed joints is expensive.

To direct water out of the wall 10, metal through-wall flashing 22 is affixed to outer face of inner wythe 12 by any of several methods. One method is to insert an edge of flashing into a horizontal joint of the inner wythe 12, such as when the inner wythe 12 is made of masonry blocks. Another method is to insert the edge of the through-wall flashing 22 into a reglet, which is a horizontal slot or groove in an inner wythe made of poured concrete. Yet another method is to mechanically fasten the flashing to a cavity face 12*a* of the inner wythe 12 using screws and a termination bar 24. A termination bar 24 is a strip of metal or plastic with evenly-spaced screw holes and is designed to spread the load of through-wall flashing 22 evenly across the width of the bar. A termination bar may be used on any kind of inner wythe 12.

The through-wall flashing 22 runs down the cavity face 12*a* of inner wythe 12 to a horizontal ledge or shelf (e.g., horizontal leg 21*b* of lintel 21) or a wall foundation (not shown). Through-wall flashing 22 then turns and runs horizontally out of the wall 10 by extending through a mortar joint in the outer wythe 14, thereby providing a continuous path 19 that guides water horizontally through outer wythe 14. One such mortar joint is between lintel 21 and the row of bricks 18 installed on the lintel 21. Through-wall flashing 22 forms a continuous sheet that guides water to the outside surface 14*a* of outer wythe 14 and prevents water from reaching the interior of the building.

At a fenestration 30 (e.g., an opening for a door, window, louver, vents, etc.), an L-shaped lintel 21 extends across the opening and is supported by masonry members 18 (e.g., bricks) on either side of fenestration 30. Masonry members 18 above the opening are supported on the lintel 21. For an outer wythe 14 made of brick, lintel 21 is typically made of steel and has a vertical leg 21*a* with a height of about 3.5 inches and a horizontal leg 21*b* with a width of about 4.5 inches. Since lintel 21 is dimensioned to support bricks 18, a gap 28 remains between the inner wall 12 and the outer wall 14 at a top edge of fenestration 30. To close this gap 28 so that it is not visible, a piece of wood or polystyrene insulation may be installed between the inner wythe 12 and vertical leg 21*a* of the lintel 21 with the wood or metal header trim 36 extending across the gap 28. It is not uncommon to fill the air gap 28 along the header with spray foam or polystyrene insulation.

Since the water travels horizontally when the through-wall flashing 22 meets the lintel 21 or other ledge, an end dam 25 is commonly used to prevent moisture from traveling across the through-wall flashing 22 and into the wall 10. An end dam 25 also prevents moisture from entering the air cavity 20 when the through-wall flashing 22 is flat or has a slight upward slope towards the outside of the outer wall 14, a condition that may result in pooling. To further direct water away from outer wythe 14, a drip edge 26 may be installed across the horizontal leg 21*b* of the lintel 21, where the drip edge 26 extends beyond the outside surface 14*a* of outer wythe 14. Another option for closing the gap 28 between the inner and outer wythes along fenestration 30 is to select lintel 21 having a wider horizontal leg 21*b* so that vertical leg 21*a* abuts the insulation 29 on inner wythe 12 and horizontal leg 21*b* extends to cavity face 12*a* of inner wythe 12. A variation on this option is a lintel 21 having a rearwardly-extending leg (not shown) that extends from vertical leg 21*a* to inner wythe 12, thereby at least partially closing gap 28.

Through-wall masonry flashing 22 traditionally is made of heavy gauge copper or lead sheet that requires trained metal workers to install it correctly. Laps and seams need to be soldered, which is difficult to do properly in a watertight fashion.

SUMMARY OF THE INVENTION

Open weeps and the lack of outward-tilting horizontal legs of steel lintels are problematic to effective drainage of cavity walls such as those used in masonry construction. Weep inlet openings are commonly found clogged by mortar or positioned too high on the flashing to be effective. Expecting an outward-tilting horizontal leg 21*b* of a steel lintel 21 is unreasonable since the position of the steel lintel 21 is seldom if ever specified in a set of construction drawings.

Another problem with current cavity construction and flashing methods is that the water between the back-up wall and the façade or outer wall (e.g., inner and outer wythes, respectively) is directed in a horizontal direction through the outer wall. When construction materials soften and drool, this causes staining on the outside surface of the outer wall. Construction materials may also have a much shorter life expectancy than the building itself. When these materials degrade, they must be replaced, which is difficult and costly.

Another problem with current cavity construction and flashing methods is that fire in a burning building is often fed by air passing through fenestrations. When flames reach out through the fenestration and up the wall of the building, the intense heat quickly destroys finishes, polystyrene or spray foam, and other materials along the header portion of fenestrations. Of particular concern are the upper corners of the fenestration, where heat from a fire quickly destroys wood, foam insulation, and other materials between the inner and outer walls and then continues to race up through the air gap between inner and outer walls. As may be predicted, the ability of the fire to travel up the wall enables the fire to spread more quickly to upper floors of the building.

Building codes require insulation to be attached to the cavity face of the inner wythe or back-up wall to allow continuous integrated insulation. Also, fire codes in the US now require improved fire blocking around doors and windows to prevent the fire from quickly traveling up the wall between the back-up wall and the outer wall or façade (e.g., inner and outer wythes, respectively.) Specifically, International Building Code (IBC) requires fire testing compliance with NFPA 285 for exterior wall assemblies having non-combustible components such as foam plastic insulation, combustible claddings, and combustible air and water barriers. Buildings over forty feet tall or having foam plastic or foam plastic core materials also require NFPA 285 compliance. The 2015 NFPA 285 1: Fire Code of the National Fire Protection Association is incorporated by reference in its entirety.

In one test, flame spread for a 78"-wide window opening shall not reach ten feet above the top of the window opening or reach five feet laterally from the window's centerline. Also, thermocouples located in the wall to the sides and above the window opening shall not reach 1000° F. during the test. Builders and teams testing for compliance with NFPA 285 have met these performance requirements by adding components to the wall construction that would not otherwise be present. For example, stainless steel sheet metal is bent to a shallow U-shaped channel and wrapped around the horizontal and vertical edges of the window opening. The stainless steel channels prevent flames from reaching the insulation in the wall cavity. As a result, such an approach reduces heat inside the wall and prevents the insulation from burning. This approach, however, facilitates passing the NFPA 285 test, but it is not consistent with actual construction practices. With no available flashing product designed for fire shielding, a need exists for a fire shield flashing system and method of fenestration flashing for masonry construction.

An object of the present invention is to provide a fire shield flashing system that is adaptable to different dimensions of a wall cavity, fenestration width, and/or structural wall assembly.

Another object of the present invention is to eliminate or reduce the need for on-site metal fabrication machinery and personnel schooled in metal fabrication.

Yet another object of the present invention is to provide a fenestration flashing system having a finish material that closes the gap between the façade or outer wythe and the back-up wall or inner wythe when installed along a fenestration header of a cavity wall.

The present invention accomplishes these and other objectives by providing a fenestration flashing system and method of fire shield flashing for cavity wall and non-cavity wall construction. In one embodiment, a fenestration flashing system includes a body member having a planar header leg extending horizontally from a rearward end to a forward end, a vertical leg extending upward from the forward end of the header leg, and a positively-sloped drainage leg extending upwardly and rearwardly from a top end of the vertical leg. A vertical termination leg extends vertically from a position proximate a rearward end of the positively-sloped drainage leg and may be monolithically formed as part of the body member or may be a part of a distinct termination member. In one embodiment, an optional weep fabric is affixed to the vertical leg. The vertical termination leg and the positively-sloped drainage leg define a downward drainage path or drainage plane to the vertical leg. The weep fabric wicks moisture along the vertical leg of the flashing header member downward and out of an air cavity of the cavity wall.

In another embodiment, the body member includes the vertical termination leg formed continuously with the positively-sloped drainage leg.

In another embodiment, the vertical termination leg is part of a distinct termination member. The vertical termination leg is constructed to abut or contact a cavity face of a back-up wall or inner wythe. The termination member also includes a positively-sloped transition leg extending downwardly and forward from a lower end of the vertical transition leg, where the positively-sloped transition leg is sized and constructed to adjustably overlap and abut the positively-sloped drainage leg of the body member.

In another embodiment, the flashing system includes an end member sized and shaped to be installed in contact with an inside surface of the body member and to fit within a flashing cavity that is substantially defined by the cavity face of the back-up wall or inner wythe, the horizontal leg, the vertical leg, and the positively-sloped drainage leg.

In another embodiment, the end member has an end-facing body portion defined within a plurality of edges and a plurality of side faces extending substantially perpendicularly from respective ones of the plurality of edges of the body portion. Each side face is constructed for attachment to the body member.

In another embodiment, the flashing system includes a quantity of insulation disposed within the flashing cavity, whether contemporaneous with manufacture or with installation of the body member.

In another embodiment, the flashing system includes at least one coupler member having a coupler member positively-sloped leg and a coupler member vertical leg, where the coupler member is sized and shaped to abut inside surfaces of the corresponding positively-sloped drainage leg and the vertical leg of the body member.

In another embodiment, the flashing system includes at least one jamb member having a jamb member face portion and a jamb member body portion extending substantially perpendicularly from the face portion to define an L-shape, and a jamb member tab portion extends substantially perpendicularly from the top margin of the jamb member body portion in a second L-shape, where the tab portion is configured to overlap the header leg of the body member. The jamb member is configured to be installed with the body portion against the jamb of the fenestration opening and the face portion abutting the cavity face of the back-up wall or inner wythe.

In another embodiment, the vertical leg and the vertical transition leg are substantially parallel, thereby defining an angle between the vertical leg and the positively-sloped drainage plane that is an alternate interior angle of a transition angle defined between the vertical transition leg and the positively-sloped drainage leg.

In another aspect of the present invention, a method of flashing a fenestration (e.g., a cavity wall) includes the steps of providing one or more body members each having a planar header leg extending horizontally from a rearward end to a forward end, a vertical leg extending upward from the forward end of the header leg, a positively-sloped drainage leg extending upwardly and rearwardly from a top end of the vertical leg; providing a vertical termination leg extending vertically from a position proximate a rearward end of the positively-sloped drainage leg; and installing the body member(s) along a fenestration header portion with the header leg abutting an underside of a rough opening header of the fenestration header portion and extending forward of a cavity face of an inner wythe or back-up wall of the cavity wall, the vertical leg abutting or positioned in close proximity to a cavity face of an outer wythe or facade of the cavity wall, and the vertical transition leg being fixedly attached to the cavity face of the inner wythe or back-up wall. The method of flashing similarly applies to non-cavity walls, where a cladding or finish material (e.g., stucco or EIFS) is installed against the structure.

In another embodiment, the method includes selecting the body members with the vertical transition leg constructed to abut a cavity face of an inner wythe or back-up wall and including a positively-sloped transition leg extending downwardly and forward from a lower end of the vertical transition leg, where the vertical transition leg and the positively-sloped termination leg define a termination member that is adjustably attachable to the body member with the positively-sloped termination leg overlapping and abutting the positively-sloped drainage leg of the flashing header member. The method also includes installing the vertical termination leg in abutment with the cavity face of the inner wythe or back-up wall and the positively-sloped termination leg overlapping and abutting the positively-sloped drainage leg of the body member.

In another embodiment, the step of providing one or more body members includes selecting the body member(s) having the vertical termination leg being formed as a continuous with the positively-sloped drainage leg of the body member.

In another embodiment, the method also includes providing at least one end member sized and shaped to close a flashing cavity substantially defined by the cavity face of the inner wythe or back-up wall, the horizontal leg, the vertical leg, and the positively-sloped drainage leg, thereby substantially blocking airflow into the flashing cavity; and installing the end member in abutment with an inside surface or an outside surface of the header member.

In another embodiment of the method, the step of providing at least one end member includes selecting the at least one end member comprising an end-facing body defined within a plurality of edges and a plurality of side faces extending substantially perpendicularly from respective ones of the plurality of edges of the end-facing body, wherein the end member is constructed for fixed attachment to the flashing header member.

In another embodiment, the method includes affixing a weep fabric to the vertical leg of each of the one or more body members. In another embodiment of the method, the step of providing one or more body members includes selecting the body member(s) to include a weep fabric affixed to the vertical leg. In some embodiments, the weep fabric extends below a lower end of the vertical leg. In some embodiments, a lower end of the weep fabric defines a plurality of tabs.

In another embodiment, the method includes the step of disposing a quantity of insulation within a flashing cavity substantially defined by the cavity face of the inner wythe or back-up wall, the horizontal leg, the vertical leg, and the positively-sloped drainage leg. In one embodiment, the insulation is a non-combustible insulation, such as mineral wool.

In another embodiment, the method also includes providing one or more jamb members that each include a jamb member face portion, a jamb member body portion extending substantially perpendicularly from the jamb member face portion and defining an L-shape, and a jamb member tab portion extending substantially perpendicularly from a top margin of the jamb member body portion to define a second L-shape. The jamb member(s) is (are) installed with each jamb member body portion abutting a jamb of the fenestration opening, each jamb member tab portion positioned between and abutting the header leg of the body member, and the jamb member face portion abutting the cavity face of the inner wythe or back-up wall of the cavity wall.

In another embodiment, the method includes providing at least one coupler member having a coupler member positively-sloped leg and a coupler member vertical leg, wherein the coupler member is sized and shaped to abut an inside surfaces of the corresponding positively-sloped drainage leg and the vertical leg of the header member.

In another embodiment, the step of providing one or more body members includes selecting each of the one or more body members with the vertical leg and the vertical termination leg being substantially parallel, thereby defining an angle between the vertical leg and the positively-sloped drainage plane that is an alternate interior angle of a transition angle defined between the vertical termination leg and the positively-sloped drainage plane.

DETAILED DESCRIPTION OF THE PREFERRED EMBODIMENT

Figure 1:
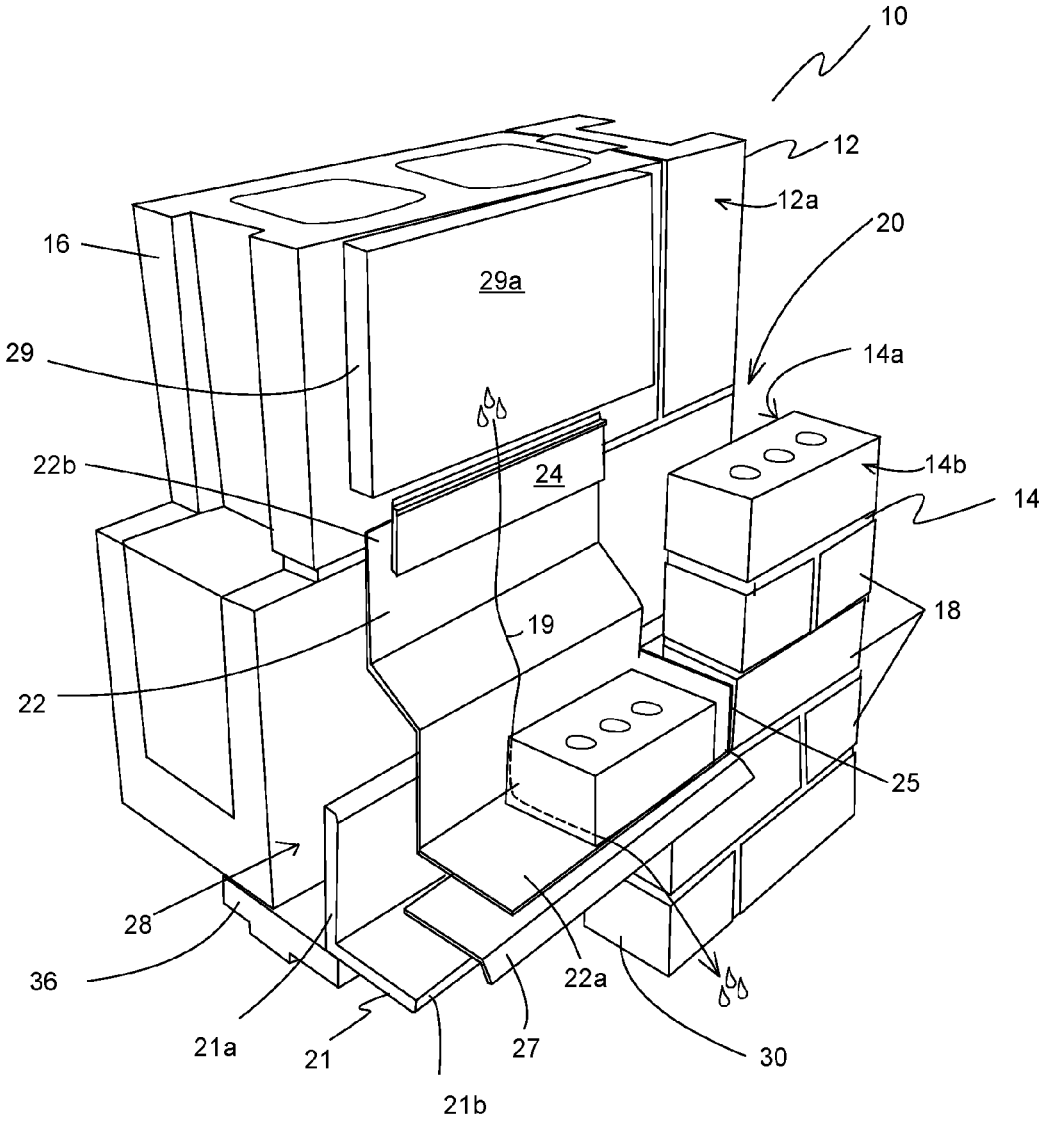
FIG. 1 is a perspective illustration showing components of prior art masonry construction.
Figure 2:
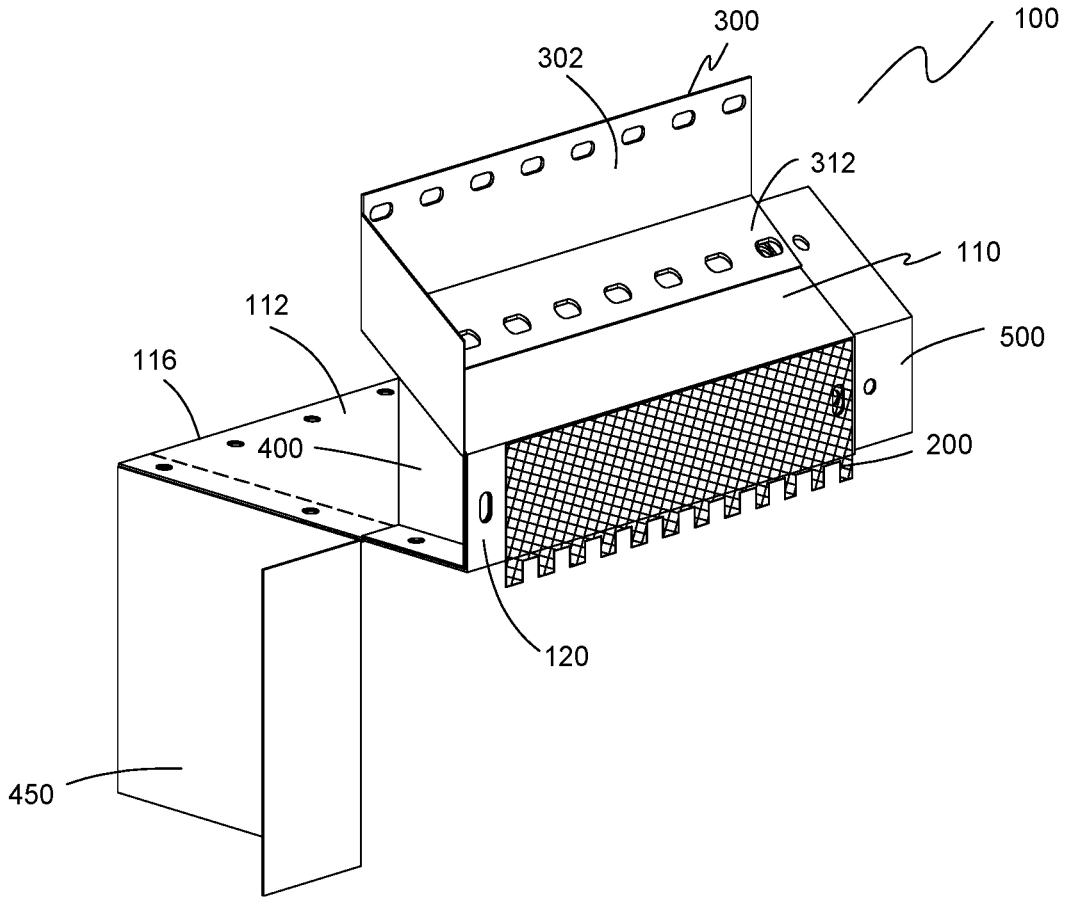
FIG. 2 is a perspective illustration of one embodiment of a fenestration flashing system of the present invention.

The preferred embodiments of the present invention are illustrated in FIGS. 2-9. FIG. 2 is a front, side, and top perspective view of one embodiment of a fire shield flashing system 100 of the present invention. Fire shield flashing system 100 includes a body member 110, a vertically-oriented weep fabric 200 affixed to a vertical leg 120 of body member 110, a termination member 300 with a vertical termination leg 302 that connects body member 110 to inner wythe 612 (shown in FIG. 7), and one or more optional end member 400. To connect together adjacent body members 110 and prevent water from seeping through seams between them, fire shield flashing system 100 optionally includes one or more couplers 500, each of which is installed behind and overlapping adjacent body members 110.

Although embodiments of fire shield flashing system 100 are discussed herein with reference to a masonry cavity wall, fire shield flashing system also applies to non-masonry construction having a back-up wall (rather than inner wythe 612) and a façade (rather than outer wythe 614). Accordingly, it is understood that the terms "back-up wall" and "façade" may be used interchangeably with the terms "inner wythe" and "outer wythe," respectively.

For the purposes of this disclosure, the terms up and down are used to refer to fire shield flashing system 100 when it is installed in a fenestration of a cavity wall and oriented as shown in FIG. 2. The terms "forward" and "rearward" are used in this disclosure consistent with FIGS. 2-8, where "forward" means towards the outside of the building and the term "rearward" means towards the inside of the building.

Figure 3:
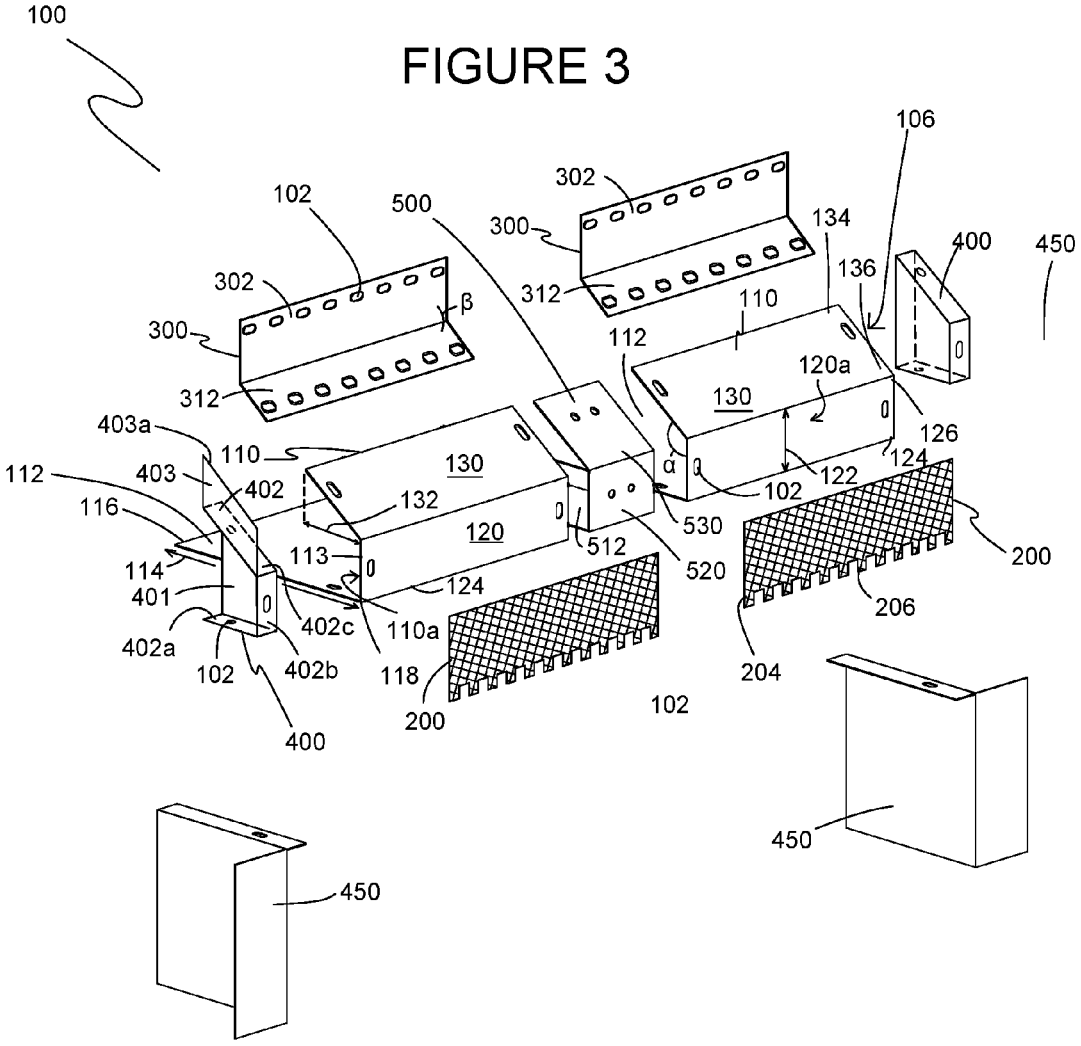
FIG. 3 is a perspective, exploded illustration of components of another embodiment of a fenestration flashing system of the present invention.

Turning now to FIG. 3, one embodiment of fire shield flashing system 100 is illustrated in an exploded, perspective view. Body member 110 includes a planar header leg 112 that extends substantially horizontally and is sized to extend rearward partially or completely across an underside of rough opening header 610 of inner wythe 612 and also extend forward beyond inner wythe 612 across cavity 620 towards outer wythe 614 (shown in FIGS. 7-8). When installed with header leg 112 on an underside of rough opening header 610 of a fenestration of a cavity wall, body member 110 is adjusted to substantially close air cavity 620 between inner wythe 612 and outer wythe 614.

Figure 7:
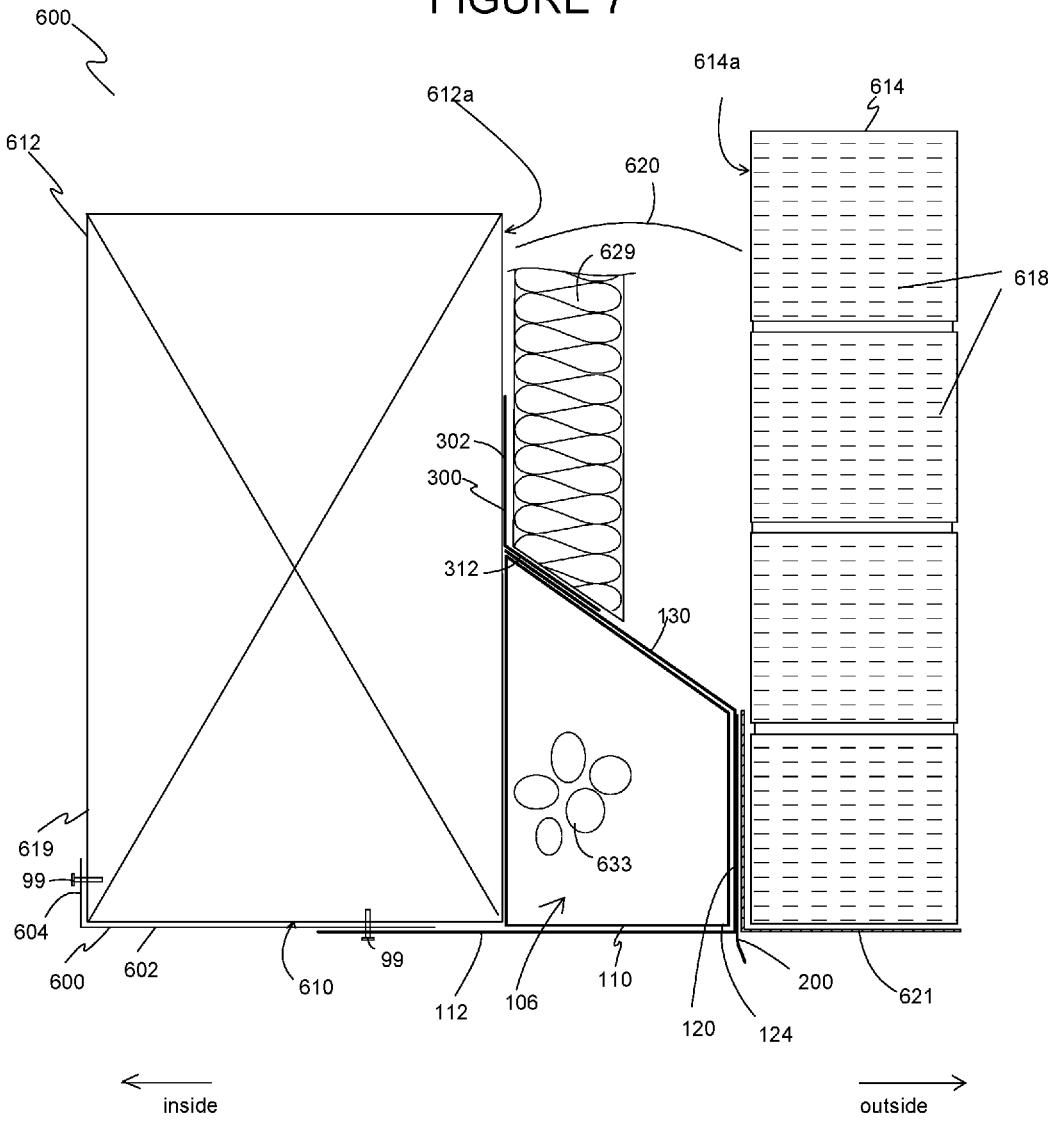
FIG. 7 is a side, sectional view of a masonry wall showing one embodiment of a fenestration flashing system installed.
Figure 8:
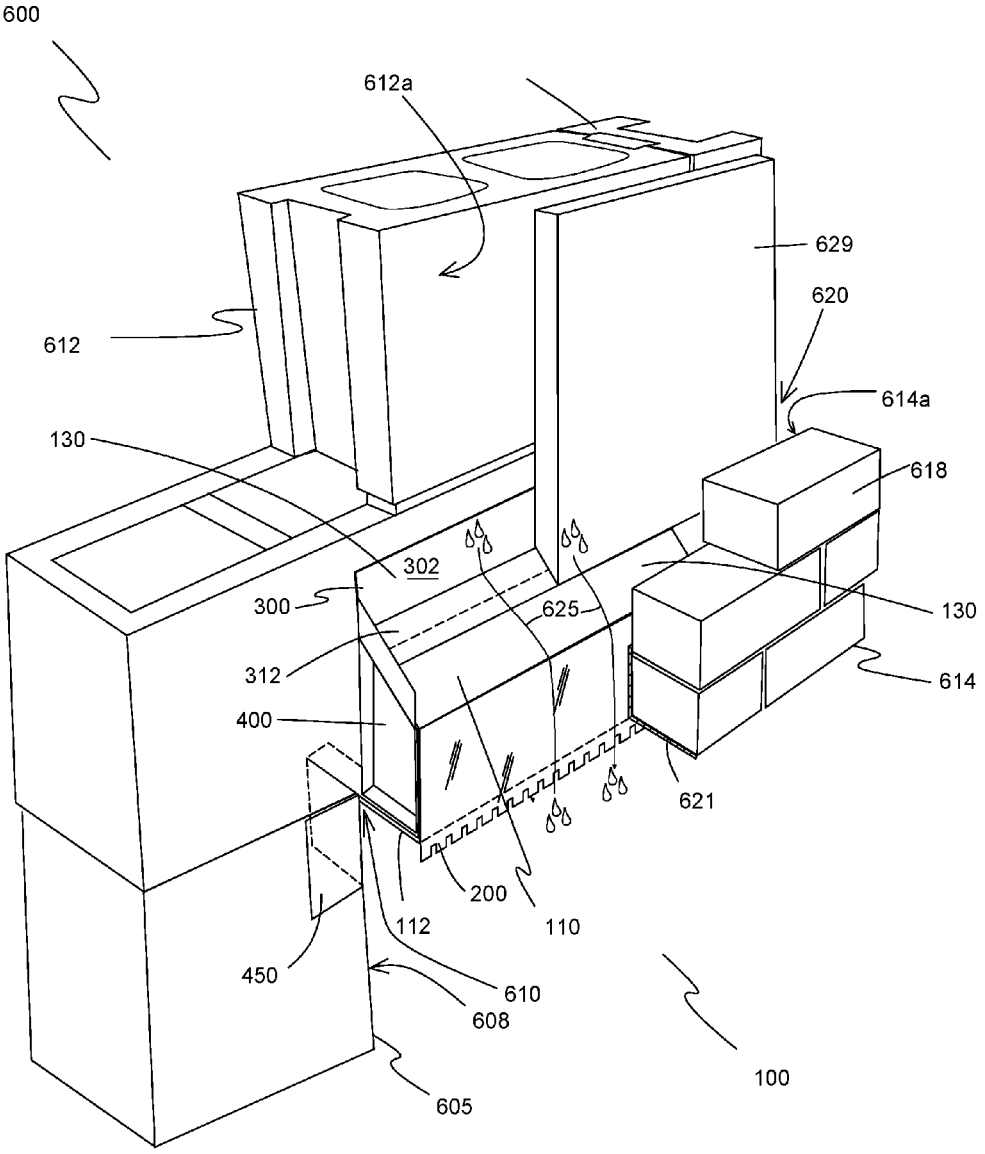
FIG. 8 is a perspective illustration of a cavity wall with one embodiment of a fenestration flashing system installed at a fenestration.

In one embodiment, body member 110 is approximately six to twelve inches in length 114 from rearward end 116 to forward end 118, with a portion of length 114 extending forward across an underside of a rough opening header 610 and between zero and about six inches extending across air cavity 620 towards cavity face 614*a* of outer wythe 614 (shown in FIGS. 7-8). Length 114 of header leg 112 can be sized as needed for the thickness of inner wythe 612 (i.e., thickness of the underside of rough opening header 610) and size of air gap 620. Air gap 620 typically is between zero and six inches. For most effective fire protection, length 114 is sized to fully cover underside of rough opening header 610.

A vertical leg 120 extends upwardly from forward end 118 of header leg 112. In one embodiment, vertical leg 120 is about two inches or more in height 122 from a vertical leg lower margin 124 to a vertical leg upper margin 126. In one embodiment, vertical leg 120 is the forward-most portion of body member 110. When installed, vertical leg 120 is positioned in air cavity 620 and in close proximity to, abutting, or in contact with cavity face 614*a* of outer wythe 614. As such, body member 110 extends across air cavity 620 to substantially close air flow to cavity 620. In some installations, body member 110 is installed with vertical leg 120 spaced about ⅜ inch or less from cavity face 614*a* of outer wythe 614. Any resulting gap between vertical leg 120 and cavity face 614*a* can be closed with placement of a backer rod and/or intumescent sealant as needed.

A positively-sloped drainage leg 130 extends upwardly and rearwardly from vertical leg upper margin 126 and rearwardly towards cavity face 612*a* of inner wythe 612 (i.e., extending in the general direction as rearward end 116, but with an upward slope.) In some embodiments, positively-sloped drainage leg 130 extends a horizontal distance 132 sufficient to abut or nearly abut inner wythe 612 when vertical leg 116 abuts cavity face 614*a* of outer wythe 614. Positively sloped leg 130 defines an internal angle $\alpha$ with vertical leg 120. In one embodiment, angle $\alpha$ is from about 105° to 120°, with some embodiments having angle $\alpha$ of about 105°. A forward end 136 of positively-sloped drainage leg 130 is directly connected to or continuous with upper margin 126 of vertical leg 120. Positively-sloped drainage leg 130 functions as a drainage plane for moisture between inner wythe 612 and outer wythe 614 that provides a continuous moisture drainage path away from inner wythe 612 and down the forward face 120*a* of vertical leg 120. As is commonly used on moulding at exterior window sills and the like, a slope of about 15° to a horizontal plane (i.e., 105° to a vertical plane) is adequate to drain water from the structure.

Termination member 300 is a separate component adapted to join inner wythe 612 to positively-sloped drainage leg 130. Termination member 300 includes vertical termination leg 302 and a positively-sloped termination leg 312 that define an internal angle $\beta$. Termination leg 302 is constructed to interface with positively-sloped drainage leg 130. In one embodiment, angle $\beta$ is substantially equal to angle $\alpha$. That is, when vertical termination leg 302 is parallel to vertical leg 120, angle $\alpha$ and angle $\beta$ are alternate interior angles. In other embodiments, angle $\beta$ is not the same as angle $\alpha$, but termination member 300 and body member 110 together are constructed to interface and optionally be attached together with positively-sloped termination leg 312 abutting and extending partially along positively-sloped drainage leg 130 of body member 110.

Positively-sloped termination leg 312 may be attached to or installed in abutment with positively-sloped drainage leg 130 of body member 110. Typically, attaching these members together is accomplished by using mechanical fasteners (e.g., screws, rivets, etc.), an adhesive disposed between abutting portions of these members, or by welding. Other methods known in the art are also acceptable. In some embodiments, termination member 300 is installed in contact with body member 110, but the two members 300, 110 are not connected to each other.

Vertical termination leg 302 is constructed to be fixedly attached to inner wythe 612, such as by using fasteners that extend through pre-defined fastener openings 102 and into inner wythe 612, by using a reglet in inner wythe 612, or by using a termination bar 24 attached to inner wythe 612 as discussed above. Therefore, termination member 300, positively-sloped drainage leg 130, and vertical leg 120 define a moisture drainage path 625 (shown in FIG. 8) from inner wythe 612 that extends away from inner wythe 612, out, and down from air cavity 620.

When termination member 300 is a separate component, horizontal length 132 of positively-sloped drainage leg 130 does not have to be accurately determined in advance for the particular structure in which fenestration flashing system 100 is to be installed. Instead, since positively-sloped termination leg 312 overlaps positively-sloped drainage leg 130, termination member 300 allows flexibility in the placement of body member 110 while also enabling water to drain from inner wythe 612 onto the drainage plane of positively sloped drainage leg 130 and out of air cavity 620.

To facilitate drainage of water out of air cavity 620, weep fabric 200 is optionally affixed to vertical leg 120 where it functions as a dedicated pathway for water movement. In one embodiment, positively sloped drainage plane 130 is contiguous with weep fabric 200 on vertical leg 120. In one embodiment, weep fabric 200 is or contains natural or synthetic fibers that move water by way of a wicking action or capillary action. Wicking is also known as fiber tow infiltration. In other embodiments, weep fabric 200 is porous. In contrast to prior-art through-wall flashing and drainage systems, weep fabric 200 is installed along a vertical face, namely, vertical leg 120, where lower fabric end portion 204 optionally extends vertically below lower margin 124 of vertical leg 120. In some embodiments, lower fabric end portion 204 extends about ⅛ inch to ½ inch (e.g., ¼ inch) below lower margin 124. By extending below lower margin 124, lower fabric end portion 204 is less likely to be covered by caulking or the like, which interferes with water removal from air cavity 620. Also, lower fabric end portion 204 wicks water directly to the ambient air where it can evaporate or drip from weep fabric 200.

Optionally, lower fabric end portion 204 includes a plurality of tabs 206 that extend vertically downward from weep fabric body 202. Due to the increased fabric edge path length along tabbed lower fabric end portion 124, such an embodiment has shown to improve water transfer to the ambient compared to a linear edge across weep fabric 200. In one embodiment, tabs 206 are about one inch in width and spaced about eight inches apart. Preferably, tabs 206 are located at each end of header member 110. In one embodiment, tabs 206 are initially sized intentionally longer than necessary, and then are trimmed after installation to be flush or to extend about ⅛ inch below a cured sealant.

In one embodiment, wicking fabric 200 is made of polyester, polypropylene, polypropylene nylon, or polyethylene. Wicking fabric 200 is preferably about 0.050 inches thick and weighs between five and seven ounces/square yard. Wicking fabric 200 is porous can be either woven or non-woven. A synthetic fiber material is preferred for long life, mildew resistance, and strength. The primary criterion is that wicking fabric 200 has suitable wicking characteristics to remove water from air cavity 620 by capillary action. This is unlike fibers such as cotton, which absorb and retain water.

When installed at a fenestration, body member 110, including portions of termination member 300 in some cases, defines a flashing cavity 106 bounded by inner wythe 612 and body member 110. Prior to installation, during installation, or after installation, flashing cavity 106 is optionally filled with insulation 633 (shown in FIG. 8), such as mineral wool insulation or non-combustible insulation. In one embodiment, for example, body member 110 is provided or purchased with mineral wool insulation 633 already disposed in and secured as needed within flashing cavity 106. Of course, insulation 633 may be added to flashing cavity 106 during or after installation.

Disposing insulation 633 within flashing cavity 106 buffers the transfer of heat to rigid inner wythe insulation 629 located above positively sloped drainage plane 130. In combination with inner wythe insulation 629, insulation 633 also provides a substantially continuous layer of insulation (shown in FIG. 8) that extends all the way to an underside of rough opening header 610 of fenestration header portion 619. Insulating flashing cavity 106 also provides a heat shield that slows heat transfer from below body member 110 to air cavity 620 in the event of a fire.

To retain insulating material 633 within cavity 106 and to also block air and water flow into flashing cavity 106, an optional end member 400 is attached to an open end 113 of body member 110 that in part defines flashing cavity 106. In one embodiment, end member 400 has a planar, vertical body portion 401 sized and shaped to close open end 113. One or more side faces 402 extend substantially perpendicularly from body portion 401 along respective bottom, front, and upper edges of body portion 401. Preferably, one or more side face 402 is pre-punched with fastener openings 102 and ready to be attached to body member 110. For example, one or more end members 400 are connected to body member 110 by using fasteners that extend through a fastener opening 102 in end member 400 that aligns with a corresponding fastener opening 102 in vertical leg 120, positively-sloped leg 130, and/or header leg 112. Optionally, a sealant, an adhesive, a caulk, or the like is used between end member 400 and body member 110 in conjunction with or in place of fasteners. A sealant can further reduce or eliminate air flow into flashing cavity 106 through seams between body member 110 and end member(s) 400.

In one embodiment, body portion 401 of each end member 400 substantially has the same cross-sectional size and shape as that of flashing cavity 106, which is typically a quadrilateral. Thus, end member 400 can be installed within flashing cavity 106 with at least one of side faces 402 abutting header member 110 and/or cavity face **612*a* of inner wythe 612. In some embodiments, body portion 401 substantially matches the cross-sectional shape of flashing cavity 106 where positively-sloped drainage leg 130 and vertical leg 120** are curved or define another shape.

In some embodiments, end member also includes a vertical tab 403 extending substantially perpendicularly in an upward direction from upper side face **402*c*. Vertical tab 403 is substantially parallel to and laterally spaced apart from body portion 401 by upper side face 402*c*. Preferably, vertical tab 403 has an upper margin 403*a* that is parallel to upper edge of body portion 401. Vertical tab 403 guides water to positively-sloped drainage leg 130 rather than flowing over open end 113, where it may drip or enter cavity 106**.

In some embodiments, a plurality of body members 110 are used to span the width of underside of rough opening header 610. In these cases, a flashing coupler member 500 is optionally positioned to overlap and is connected to neighboring body members 110. For example, coupler member 500 has coupler member header leg 512, coupler member vertical leg 520, and coupler member sloped leg 530 that correspond respectively to header leg 112, vertical leg 120, and positively-sloped drainage leg 130 of body members 110. Accordingly, coupler member 500 is positioned to abut the inside surface 110*a* of neighboring body members 110, thereby substantially closing a gap between these members. Optionally, a sealant or an adhesive is used at the mating faces between coupler member 500 and body members 110 to ensure a watertight seal.

To facilitate connection of components and installation of fire shield flashing system 100, a plurality of optional pre-punched, pre-machined, or pre-formed fastener openings 102 are defined in body member 110, termination member 300, end member 400, jamb member 450, coupler member 500, and/or any other member of fire shield flashing system 100. Fastener openings 102 can be holes, slots, or have other shapes. Fastener openings 102 preferably extend through a member, but optionally are formed as a knockout or mere indentation with a thickness suitable for sheet metal screws or other fastener. In one embodiment, fastener openings 102 on downwardly-sloping transition leg 312 and on positively-sloped leg 130 are slots, thereby permitting adjustable positioning and connection of these members. Fastener openings 102 in one member (e.g., body member 110) correspond to fastener openings 102 in another member (e.g., end member 400), which facilitates easy and rapid installation of fire shield flashing system 100.

Figure 4:
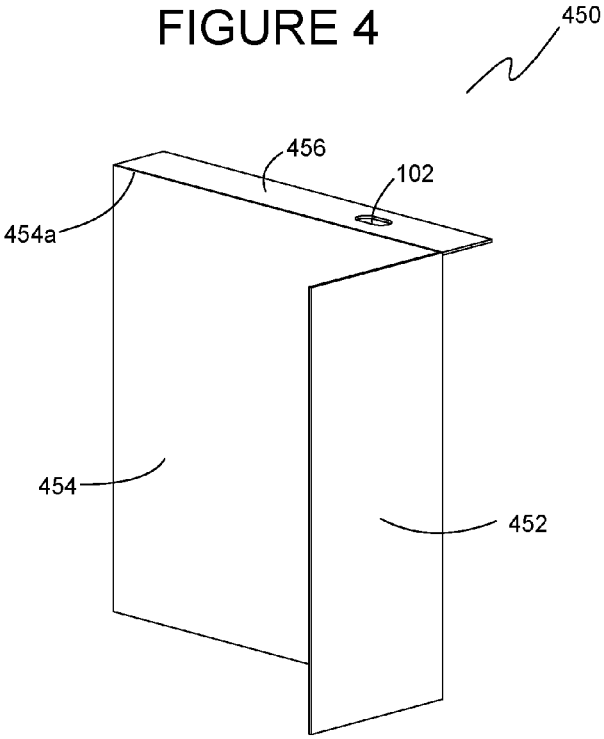
FIG. 4 is a perspective illustration of one embodiment of a jamb member of the present invention shown in FIG. 3.

Referring now to FIG. 4, a front perspective view illustrates one embodiment of a jamb member 450 shaped to be installed along the jamb adjacent an upper left fenestration corner. Since jamb member 450 for an upper right corner of fenestration is symmetrical to jamb member 450 for an upper left corner of fenestration, only the upper left jamb member 450 is discussed. In some embodiments of fenestration flashing system 100, jamb members 450 are installed on the jamb adjacent one or both upper corner of the fenestration. Each jamb member 450 protects the jamb and cavity surface 612*a* of the inner wythe 612 at the upper corner of a fenestration 605. In the event of a fire, jamb member 450 helps prevent burning or scorching and reduces heat transfer to insulation and structural members at corners of a fenestration.

In one embodiment, jamb member 450 substantially has an L-shape that includes a jamb member face portion 452 extending transversely from a jamb member body portion 454. Jamb member face portion 452 is constructed to abut cavity surface 612*a* of inner wythe 612 at an upper corner of fenestration 605. In one embodiment, jamb member face portion 452 has a rectangular shape, but may have other shapes, such as an inverted right triangle. When installed, jamb member body portion 454 extends rearwardly into fenestration 605 towards the inside of the building. In one embodiment, a jamb member tab 456 extends perpendicularly from a top margin 454*a* of jamb member body portion 454, where jamb member tab 456 is configured to extend slightly along header and overlap body member 110. Preferably, jamb member tab 456 defines one or more fastener openings 102 that correspond to fastener opening(s) 102 on header leg 112 of body portion 110.

Figure 4A:
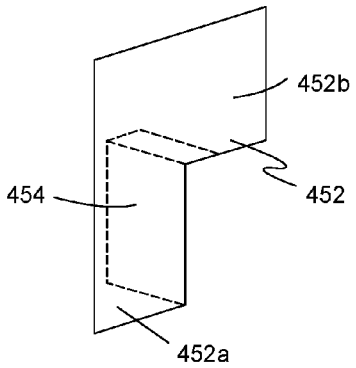
FIG. 4A illustrates an alternate embodiment of a jamb member of the present invention.

As shown in FIG. 4, jamb member face portion 452 is a rectangle with the same height as jamb member body portion 454 and that does not extend vertically above top margin 454*a*. In other embodiments as shown in FIG. 4A, jamb member face portion 452 has an inverted L-shape with one leg 452*a* that extends along the jamb and laterally away from the fenestration opening. Another leg 452*b* extends above top margin 454*a* and along fenestration opening. Thus, jamb member face portion 452 protects cavity surface 612 of inner wythe 612 from flames that lick up and around the upper corners of the fenestration.

Figure 5:
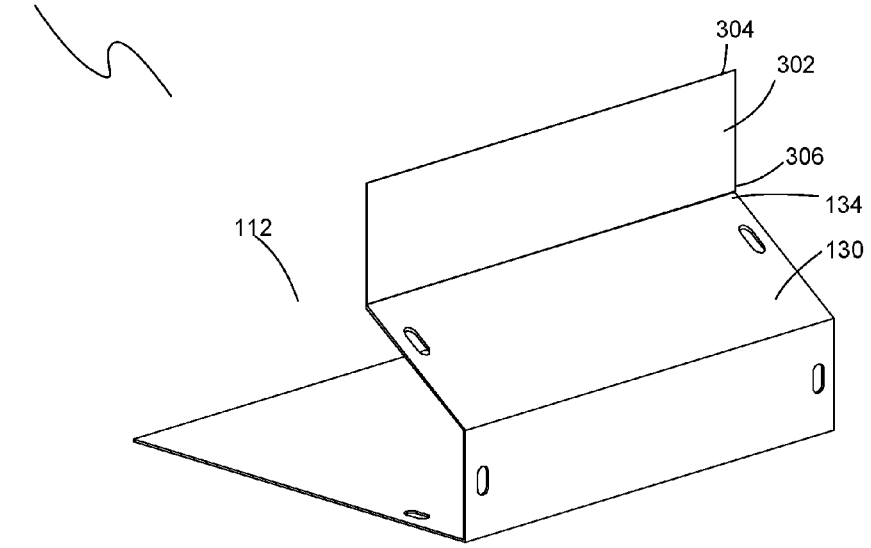
FIG. 5 is a perspective illustration of another embodiment of a flashing body member of the present invention.

Referring now to FIG. 5, another embodiment of body member 110' is illustrated in front, side, and top perspective view. Here, body member 110' is a single, contiguous piece of metal that includes vertical termination leg 302. Vertical termination leg 302 extends vertically from a lower end 306 that is connected to a rearward end 134 of positively-sloped drainage leg 130. In one embodiment, vertical termination leg 302 extends about two to four inches vertically from lower end 306 to an upper end 304; other suitable dimensions are acceptable. In the embodiment shown in FIG. 5, vertical termination leg 302 is a continuous with and extends from positively-sloped drainage leg 130. This monolithic embodiment differs from other embodiments discussed above in which vertical termination leg 302 is part of termination member 300 that is a separate component of fenestration flashing system 100 and that also includes a positively-sloped termination leg 312 for overlapping positively-sloped drainage leg 130 of body member 110 when installed.

Figure 6:
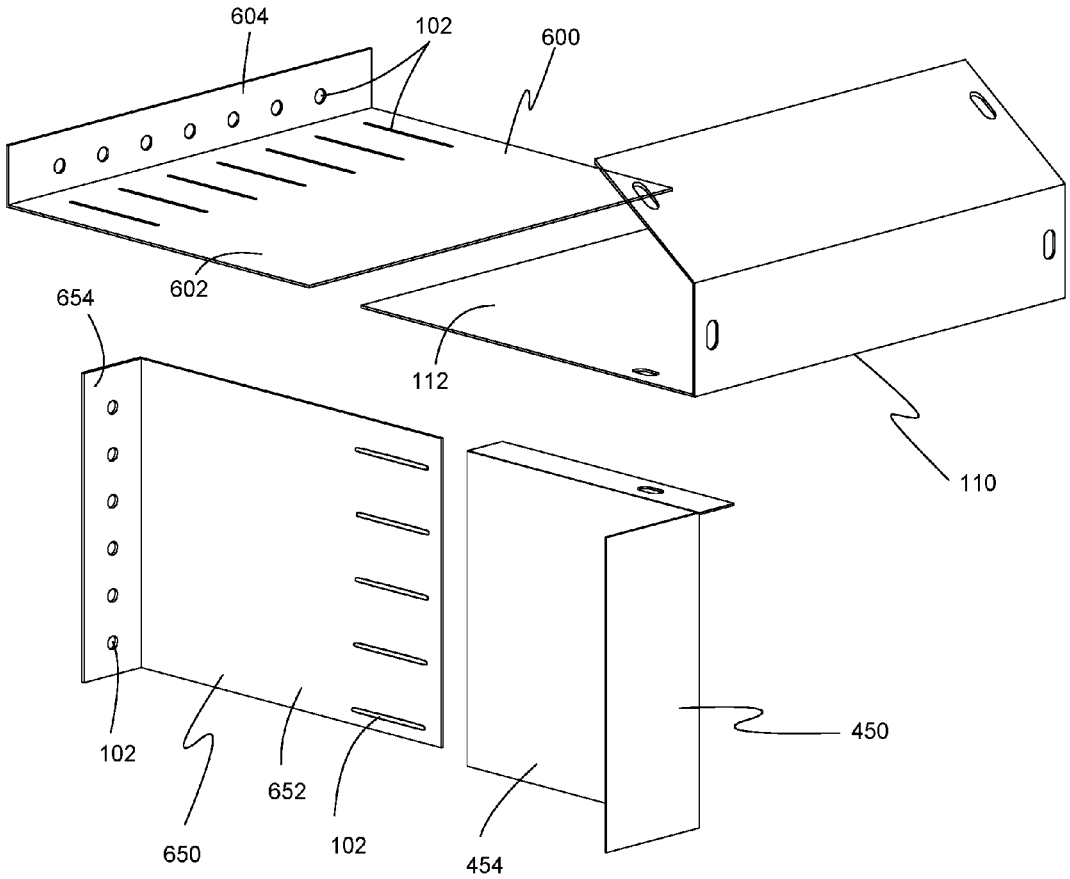
FIG. 6 is a perspective illustration showing embodiments of an interior heat shield member and an interior jamb member of the present invention.

Referring now to FIG. 6, a perspective view illustrates embodiments of an optional internal heat shield member 600 and optional internal jamb member 650. Internal heat shield member 600 has a header leg 602 sized and configured to abut the rough opening header and overlap or abut header leg 112 of body member 110. An interior vertical leg 604 extends perpendicularly from header leg 602 in an upward direction to abut the interior framing members of the fenestration opening. Preferably, header leg 602 and interior vertical leg 604 of internal heat shield member 600 are pre-punched with one or more fastener openings 102. Internal heat shield member 600 enables fire shield flashing system 100 to completely cover the header of a fenestration while also allowing for easy adjustment to variations in wall thickness.

Like internal heat shield member 600, internal jamb member 650 provides an extension of jamb member body portion 454 of jamb member 450 along the jamb of a fenestration. Internal jamb member has a internal jamb member body portion 652 and an internal jamb member face portion 654 that extend at right angles to one another in an L shape. Internal jamb member body portion 652 is sized to extend along the jamb to abut or overlap body portion 454 of jamb member 450. Internal jamb member face portion 654 is configured to abut the internal framing of the fenestration. As with other components, it is preferred that internal jamb member 650 is pre-punched with one or more fastener openings 102.

Referring now to FIGS. 7 and 8, a side sectional view and a perspective view, respectively, are illustrated of a portion of one embodiment of a cavity wall 600 with one embodiment of fenestration flashing system 100 installed at fenestration 605 between inner wythe 612 and outer wythe 614. A lintel 621 supports masonry members 618 of outer wythe 614 with outer wythe 614 being spaced apart from inner wythe 612 by air cavity 620. In one example, air cavity 620 is about four inches from cavity surface 612*a* of inner wythe 612 to cavity surface 614*a* of outer wythe 614. For clarity, jamb member 450 is not shown in FIG. 7.

Body member 110 is installed on inner wythe 612 with header leg 112 positioned below and abutting fenestration header portion 619 of inner wythe 612. Header leg 112 of body member 110 extends forward towards outer wythe 614 and turns upward forming vertical leg 120, to which weep fabric 200 is affixed. Header leg 112 extends rearward at least partially along underside of rough opening header 610 to interior insulation, framing, or finish materials (e.g., drywall). For example, header leg 112 extends rearward (i.e., towards the inside) along underside of rough opening header 610 at least two inches. Interior heat shield member 600 is attached to rough opening header 610 with header leg 602 overlapping header leg 112 and secured by a fastener 99. Interior vertical leg 604 is secured by fastener 99 to inside face of rough opening header 610.

Vertical leg 120 (with weep fabric 200 affixed thereto) is in close proximity to (e.g., about ⅜ inch or less) or abuts lintel 621 and/or cavity face 614*a* of outer wythe 614. When vertical leg 120 abuts lintel 621 (or inner face 614*a* of outer wythe 614, when no lintel 621 is present), air flow access into air cavity 620 is blocked, thereby reducing the ability of fire to spread through air cavity 620. Weep fabric 200 extends below lower margin 124 of vertical leg 120 to vacate water down and out of cavity wall 600 behind outer wythe 614.

Positively-sloped drainage leg 130 extends upwardly and rearwardly at angle $\alpha$ from vertical leg 120 towards cavity surface 612*a* of inner wythe 612. In the embodiment shown in FIG. 7, positively-sloped drainage leg 130 may or may not extend sufficiently to contact cavity surface 612*a*. Accordingly, separate termination member 300 is attached to cavity surface 612*a* of inner wythe 612 and optionally to positively-sloped drainage leg 130, thereby defining a continuous path 625 (shown in FIG. 8) for water in air cavity 620 to travel down and out of air cavity 620 via positively-sloped drainage leg 130 and vertical leg 120 with weep fabric 200. By draining water out and down from air cavity 620, rather than horizontally through outer wythe 614, fenestration flashing system 100 improves the aesthetic appeal of the façade by reducing or eliminating staining caused by water drainage, particularly when the water contains contaminants.

Inner wythe insulation 629 (e.g., rigid fiberglass board) is installed against cavity surface 612*a* of inner wythe 612 and optionally contacts positively-sloped transition leg 312 and/or positively-sloped drainage leg 130. Flashing cavity 106 of fire shield flashing system 100 is filled with non-combustible flashing cavity insulation 633 (e.g., mineral wool insulation). With inner wythe insulation 629 installed along cavity surface 612*a* and flashing cavity insulation 633 disposed in flashing cavity 106, cavity wall 600 is insulated substantially continuously to underside of rough opening header 610. End member 400 (not shown in FIG. 7 for clarity; shown in FIG. 8) is installed in flashing cavity 106 to hold insulation 633 in place as well as to block air flow into flashing cavity 106. As shown in FIG. 8, jamb member 450 is installed at the upper left corner of fenestration 605 with jamb member face portion 452 against cavity surface 612*a* of inner wythe 612.

Figure 9:
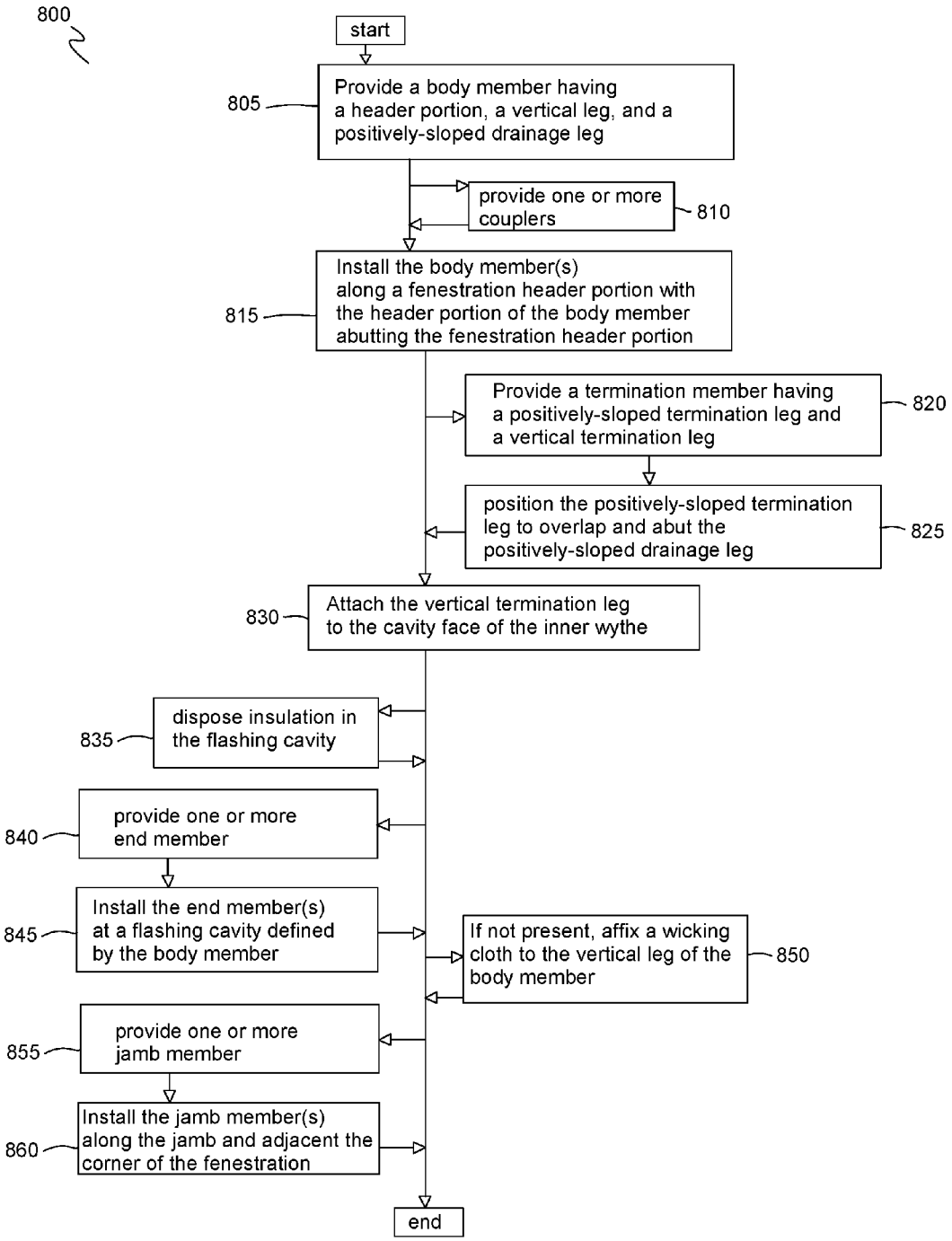
FIG. 9 is a flow chart illustrating exemplary steps of a method of flashing a fenestration of the present invention.

Referring now to FIG. 9, a method 800 of flashing a fenestration 605 of a cavity wall 600 is now described. In some embodiments, cavity wall 600 is a masonry wall, however, method 800 applies to cavity walls 600 with claddings made of other materials. Although method 800 is described for cavity wall 600, flashing system 100 of the present invention may similarly be installed on non-cavity walls, such as EIFS and stucco finishes. For example, in non-cavity construction, the exterior cladding assumes the role of the façade or outer wythe 614 and is installed in abutment with insulation 629 or the back-up wall or inner wythe 612. Similar to as shown in FIG. 7, this could be where gap 620 is completely filled with insulation or where the cladding (e.g., EIFS instead of bricks 618) is installed against face 612*a* of a back-up wall or inner wythe 612.

In step 805, one or more body members 110 are provided, where each body member 110 has a planar header leg 112 extending horizontally from a rearward end 116 to a forward end 118, a vertical leg 120 extending upward from forward end 118 of header leg 112, and a positively-sloped drainage leg 130 extending upwardly and rearwardly from a top end 134 of vertical leg 120.

Optionally, one or more body members 110' may be selected instead of body members 110. Flashing body member(s) 110' include a vertical termination leg 302 extending vertically from a rearward end 134 of positively-sloped drainage leg 130. For example, vertical termination leg 302 is continuous with and integrally attached to positively-sloped drainage leg 130 of body member 110. In another embodiment as discussed below in steps 815 and 820, vertical termination leg 302 is part of termination member 300.

Whether selecting body member 110 or body member 110', there is the option of having a weep fabric 200 affixed to the vertical leg 120. In one embodiment, weep fabric 200 is sized to have a lower end 204 extend below the forward end of the header leg 112. Optionally, weep fabric 200 includes a plurality of tabs 206 along a lower end 204.

When more than one body member 110 is required to span a fenestration opening, one or more coupler members 500 are provided as noted in step 810. Each coupler member 500 has coupler member positively-sloped leg 530 and coupler member vertical leg 520, where the coupler member 500 is sized and shaped to abut an inside surface 110*a* of the corresponding positively-sloped drainage leg 130 and the vertical leg 120 of body member 110. Each coupler member 500 may optionally include coupler member header leg 512.

In step 815, the flashing header member(s) 110 or 110' are installed along a fenestration 605 with header leg 112 abutting underside of rough opening header 610 and extending forward of a cavity face 612*a* of a back-up wall 612 of the cavity wall 600 and the vertical leg 120 abutting or positioned in close proximity to a cavity face 614*a* of a façade 614 of the cavity wall 600. When an optional weep fabric 200 is attached to vertical leg 120, vertical leg 120 is considered to be abutting back-up wall 612 when weep fabric is in contact with back-up wall 612 whether or not vertical leg 120 directly contacts back-up wall 612. The flashing header member(s) 110 or 110' extend from a first upper corner (e.g., upper left corner) to a second upper corner (e.g., upper right corner) of the fenestration. When one or more body members 110 or 110' are installed in a single fenestration, optional coupler members 500 may be provided where a coupler member 500 is installed between neighboring body members 110 or 110', as the case may be.

In step 820, when body member 110 is used, one or more termination members 300 is provided. Termination member 300 has vertical termination leg 302 and positively-sloped transition leg 304. Positively-sloped termination leg 304 is adjustably attachable to body member 110 with the positively-sloped termination leg 304 overlapping and abutting positively-sloped drainage leg 130 of body member 110.

In step 825, positively-sloped termination leg 304 is positioned to overlap and abut positively-sloped drainage leg 130 of body member 110. In one embodiment, positively-sloped termination leg 304 is fixedly attached to positively-sloped drainage leg 130 of body member 110, such as by using fasteners, adhesive, welding, or other method known in the art of sheet metal fabrication.

In step 830, vertical termination leg 302 is fixedly attached to the cavity face 612*a* of the back-up wall 612.

In step 835, insulation is optionally disposed in the flashing cavity. In either case where body member 110 or body member 110' is used, a quantity of optional, non-combustible insulation 633 is disposed within flashing cavity 106 substantially defined by the cavity face 612*a* of the back-up wall 612, horizontal leg 112, vertical leg 120, and positively-sloped drainage leg 130. Step 835 may be performed contemporaneously with forming body member 110 or with installation of body member 110.

In step 840, one or more end members 400 is optionally provided, where each end member 400 is sized and shaped to close a flashing cavity 106 substantially defined by cavity face 612*a* of the back-up wall 612, horizontal leg 112, vertical leg 120, and positively-sloped drainage leg 130 of body member 110, 110', thereby substantially blocking airflow into flashing cavity 106. In one embodiment of the method, end member(s) 400 have a body portion 401 and a plurality of side faces 402 extending substantially perpendicularly from a corresponding edge of body portion 401, where each side face 402 is constructed for fixed attachment to the body member 110.

In step 845, end member(s) 400 are installed on body member 110, 110' so as to close or substantially close an opening to flashing cavity 106. In one embodiment, end member 400 is installed in abutment with an inside surface 110*a* of body member 110. Attachment may be accomplished using fasteners, adhesive, or other methods known in the art of sheet metal fabrication.

In step 850, weep fabric 200 is optionally installed if it is not present. As when selecting a body member 110, 110' without the optional weep fabric already affixed to the vertical leg 120, a weep fabric may be affixed to vertical leg 120 of each body member 110, 110'. In one embodiment, weep fabric 200 is optionally sized to extend below forward end 118 of the header leg 112. In another embodiment, weep fabric 200 includes a plurality of tabs 206 along a lower end 204.

In step 855, one or more jamb members 450 optionally are provided. Jamb member(s) 450 include a jamb member face portion 452 and a jamb member body portion 454.

In step 860, each jamb member 450 is installed with jamb member face portion 452 abutting cavity face 612*a* of back-up wall 612 of cavity wall 600 and jamb member body portion 454 against the jamb.

Fenestration flashing system 100 interrupts, redirects, and stops water from entering a fenestration header portion and thereby protects fenestration header portion from water dams. Components of fenestration flashing system 100 are made of stainless steel, such as stainless steel sheet metal having a gauge of 22, 24, 26, or 28.

The life expectancy of stainless steel is approximately 100 years or more and is UV stable, waterproof, weather resistant, will not soften or drool, and is compatible (i.e., inert) with a full range of sealants. The quick-connect joints with pre-defined fastener openings 102 allows for secure coupling and joining of system components. Consistent spacing and hole sizes of fastener openings 102 are pre-defined in the factory, so fenestration flashing system 100 can be assembled by low-skill-set tradespeople. Fenestration flashing system 100 also enables installation compliance to be done prior to installation of the exterior façade. Fenestration flashing system 100 supports membrane flashing overlays, such as through-wall masonry flashing.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

The invention claimed is:

1. A fire-shield flashing system for an exterior rough opening in a cavity wall having a header and side jambs, the system comprising:

a body member having a planar header leg extending horizontally from a rearward end to a forward end, a vertical leg extending upward from the forward end of the header leg, a positively-sloped drainage leg extending upwardly and rearwardly from a top end of the vertical leg;

a vertical termination leg extending vertically from a position proximate a rearward end of the positively-sloped drainage leg, wherein the vertical termination leg and the positively-sloped drainage leg define a downward drainage path to the vertical leg; and at least one jamb member for each of the side jambs, each of the at least one jamb member comprising:

a jamb member face portion;

a jamb member body portion continuous with and extending substantially perpendicularly from the jamb member face portion; and a jamb member tab continuous with and extending substantially perpendicularly from a top margin of the jamb member body portion, wherein when installed in the exterior rough opening of the cavity wall, the planar header leg extends towards the rearward end of the planar header leg at least partially across an underside of the header of the exterior rough opening, the vertical leg is disposed in an air cavity between an inner wythe and an outer wythe of the cavity wall, the vertical termination leg is attached to a cavity surface of the inner wythe, the jamb member body portion abuts one of the side jambs, the jamb member face portion abuts the cavity face of the inner wythe, and the jamb member tab portion overlaps the header leg of the body member.

2. The fire-shield flashing system of claim 1, further comprising a weep fabric affixed to the vertical leg of the body member, wherein the weep fabric is configured to wick moisture along the vertical leg downward and out of the air cavity of the cavity wall.

3. The fire-shield flashing system of claim 1, wherein the vertical termination leg is integrally connected to and continuous with the rearward end of the positively-sloped drainage leg.

4. The fire-shield flashing system of claim 1, wherein the vertical termination leg is constructed to abut a cavity face of the inner wythe and further comprises a positively-sloped termination leg extending downwardly and forward from a lower end of the vertical termination leg, wherein the positively-sloped termination leg is sized and constructed to adjustably overlap and abut with the positively-sloped drainage leg of the body member.

5. The fire-shield flashing system of claim 1, further comprising:

an end member made of stainless steel and sized and shaped to be installed abutting an inside surface of the body member and to fit within a flashing cavity substantially defined by a cavity face of the inner wythe, the horizontal leg, the vertical leg, and the positively-sloped drainage leg of the body member.

6. The fire-shield flashing system of claim 5, wherein the end member comprises:

an end-facing body portion defined within a plurality of edges; and a plurality of side faces extending substantially perpendicularly from respective ones of the plurality of edges of the end-facing body, wherein each of the plurality of side faces is constructed for attachment to the header member.

7. The fire-shield flashing system of claim 5, further comprising a quantity of insulation disposed within the flashing cavity.

8. The fire-shield flashing system of claim 1, further comprising:

at least one coupler member having a coupler member positively-sloped leg and a coupler member vertical leg, wherein the coupler member is sized and shaped to abut inside surfaces of the corresponding positively-sloped drainage leg and the vertical leg of adjacent body members.

9. The fire-shield flashing system of claim 1, wherein the vertical leg and the vertical termination leg of the body member are substantially parallel, thereby defining an angle between the vertical leg and the positively-sloped drainage plane that is an alternate interior angle of a transition angle defined between the vertical termination leg and the positively-sloped drainage leg.

10. A method of flashing an exterior rough opening in a cavity wall, the method comprising:

providing one or more body members made of stainless steel and each having a planar header leg configured to extend horizontally from a rearward end to a forward end, a vertical leg extending upward from the forward end of the header leg, a positively-sloped drainage leg extending upwardly and rearwardly from a top end of the vertical leg;

providing a vertical termination leg made of stainless steel and configured to extend vertically from a position proximate a rearward end of the positively-sloped drainage leg;

installing the one or more body members along an entire width of the header with the header leg of each of the one or more body members positioned against and overlapping an underside of a header of the rough opening and extending forward of a cavity face of an inner wythe of the cavity wall, the vertical leg abutting or positioned in close proximity to a cavity face of an outer wythe of the cavity wall, and the vertical termination leg being fixedly attached to the cavity face of the inner wythe of the cavity wall;

providing one or more jamb members made of stainless steel and comprising:

a jamb member face portion;

a jamb member body portion continuous and extending substantially perpendicularly from the jamb member face portion and defining an L-shape; and a jamb member tab portion continuous and extending substantially perpendicularly from a top margin of the jamb member body portion to define a second L-shape; and installing the one or more jamb members with each jamb member body portion abutting a jamb of the exterior rough opening, each jamb member tab portion positioned between and abutting the header leg of the body member, and the jamb member face portion abutting the cavity face of the inner wythe of the cavity wall.

11. The method of claim 10, further comprising:

providing one or more interior heat shield members each made of stainless steel and having a heat shield header leg and a heat shield vertical leg;

installing each of the one or more interior heat shield members along the header with the heat shield header leg overlapping the header leg of one of the one or more body members and the heat shield vertical leg attached to an interior face of the inner wythe at the exterior rough opening, thereby completely covering the underside of the header with stainless steel.

12. The method of claim 10, further comprising:

selecting the one or more body members having the vertical termination leg constructed to abut a cavity face of the inner wythe and including a positively-sloped termination leg extending downwardly and forward from a lower end of the vertical termination leg, wherein the vertical termination leg and the positively-sloped termination leg define a termination member that is adjustably attachable to the flashing header member with the positively-sloped termination leg overlapping and abutting the positively-sloped drainage leg of the body member; and installing the vertical termination leg in abutment with the cavity face of the inner wythe and the positively-sloped termination leg overlapping and abutting the positively-sloped drainage leg of the body member.

13. The method of claim 10, wherein the step of providing one or more body members includes selecting the one or more body members having the vertical termination leg being integrally formed with and continuous with the positively-sloped drainage plane of the body member.

14. The method of claim 10, further comprising:

providing at least one end member made of stainless steel and sized and shaped to close a flashing cavity substantially defined by the cavity face of the inner wythe, the horizontal leg, the vertical leg, and the positively-sloped drainage leg, thereby substantially blocking airflow into the flashing cavity; and installing the end member in abutment with of the body member.

15. The method of claim 14, wherein the step of providing at least one end member includes selecting the at least one end member comprising an end-facing body defined within a plurality of edges and a plurality of side faces extending substantially perpendicularly from respective ones of the plurality of edges of the end-facing body, wherein the end member is constructed for fixed attachment of the plurality of side faces to the body member.

16. The method of claim 10, further comprising: affixing a weep fabric to the vertical leg of each of the one or more body members.

17. The method of claim 10, wherein the step of providing one or more body members includes selecting the one or more body members each having a weep fabric affixed to the vertical leg.

18. The method of claim 10, further comprising:

disposing a quantity of insulation within a flashing cavity substantially defined by the cavity face of the inner wythe, the horizontal leg, the vertical leg, and the positively-sloped drainage leg.

19. The fire-protection system of claim 1, wherein the planar header member extends at least two inches across the underside of the header of the exterior rough opening.

20. The fire-protection system of claim 1, further comprising at least one internal heat-shield member made of stainless steel and comprising:

a heat shield vertical leg constructed to abut an interior face of the exterior rough opening; and a heat shield header leg connected to and extending perpendicularly from the heat shield vertical leg and constructed to overlap the planar header leg of the body member when installed at the header of the exterior rough opening.

* * * * *